US008056743B2

(12) United States Patent
Zanoni et al.

(10) Patent No.: US 8,056,743 B2
(45) Date of Patent: Nov. 15, 2011

(54) CROWN CLOSURE HAVING A REDUCED RADIUS AND METHOD OF MANUFACTURE

(76) Inventors: Carlos Orlando Vilachá Zanoni, Caracas (VE); Klaus Uhlig Peterssen, San antonio de Los Altos (VE)

( * ) Notice: Subject to any disclaimer, the term of this patent is extended or adjusted under 35 U.S.C. 154(b) by 2640 days.

(21) Appl. No.: 09/745,098

(22) Filed: Dec. 20, 2000

(65) Prior Publication Data

US 2001/0035390 A1 Nov. 1, 2001

(51) Int. Cl.
*B65D 41/12* (2006.01)

(52) U.S. Cl. ..... 215/328; 215/324; 215/327

(58) Field of Classification Search ..... 215/324, 215/326–328, 43, 45; 53/487–488
See application file for complete search history.

(56) References Cited

U.S. PATENT DOCUMENTS

| | | | | | |
|---|---|---|---|---|---|
| 468,258 | A | * | 2/1892 | Painter | 215/328 |
| 2,048,062 | A | * | 7/1936 | Elder | 215/328 |
| 2,099,056 | A | * | 11/1937 | Ferngren | 215/45 |
| 2,138,419 | A | * | 11/1938 | Gavin | 215/328 |
| 2,327,455 | A | * | 8/1943 | Punte | 215/328 |
| 3,171,458 | A | * | 3/1965 | Strong | 215/45 |
| 3,195,754 | A | * | 7/1965 | Brockett | 215/324 |
| 3,198,369 | A | * | 8/1965 | St. Jacques | 215/328 |
| 3,497,098 | A | * | 2/1970 | Myer | 215/328 |
| 3,648,874 | A | * | 3/1972 | Moller | 215/328 |
| 3,827,594 | A | * | 8/1974 | Leenaards | 215/324 |
| 4,269,321 | A | * | 5/1981 | Ichinose et al. | 215/328 |
| 4,782,969 | A | * | 11/1988 | Henning | 215/328 |

* cited by examiner

*Primary Examiner* — Nathan J Newhouse
(74) *Attorney, Agent, or Firm* — Eckert Seamans Cherin & Mellott, LLC; David C. Jenkins, Esquire

(57) ABSTRACT

A crown closure that includes a shell having a top, a skirt, a curved portion and a plurality of serrations and a liner. The curved portion is disposed between said top and said skirt and is adapted to be the same shape as the mouth contour of a bottle.

13 Claims, 3 Drawing Sheets

CROWN CLOSURE HAVING A REDUCED RADIUS AND METHOD OF MANUFACTURE

FIELD OF THE INVENTION

This invention relates to a crown clusure and, more specifically, to a crown closure having a curved portion which is adapted to be the same shape as the mouth contour of the bottle to which the crown closure is attached and a method of manufacturing crown closures having a reduced radius.

BACKGROUND OF THE INVENTION

In 1892 William Painter, founder of the present Crown Cork & Seal Company, was granted a patent for a beverage seal. Mr. Painter called this seal a crown because it resembled a crown of the type used by the nobility.

Natural cork disks were used in the early crowns. It was normal to have leaks in up to one percent of the closures. Later, composition cork come into use about 1915 and was an immediate success: This crown type was currently named "Standard Crown." The original principle, the bottle finish and the means of applying the crown remained practically the same for 100 years.

An important modification, still in use, was introduced many years ago: A reduction of the cork disk's thickness from ⅛ inch to 1/16 inch, and consequently, a reduction of the height in the skirt wall from 0.262 inch (Standard Crown) to approximately 0.228 inch (named "Short Skirt") was accomplished. There were also intermediate designs now forgotten.

Because the seal of composition cork is cut in disks, the lodging zone of the shell is alike and has a near cylindrical shape. During crowning there were practically no deformation of crowns in the zone between the seal surface of bottles and skirt wall of crowns, because it remained filled by the cork.

As shown in FIGS. 1A-1C, after introducing in 1955 the first commercial molded plastic liner by Bond Crown, a division of Continental Can Company, Inc. named "triple seal", it was possible to affect a significant reduction in seal volume, using practically the whole material close to the seal surface. This construction has produced an absence of seal material in the junction of the crown top and the beginning of the skirt wall, just outside to the seal surface. As a consequence, during crowning, this zone is deformed, with tendency to take the shape of the finish bottle contour.

This stretching of crowns causes tilting of crowns (crimped sideways on bottle) and high friction on internal lacquer, breaking it and making possible that internal corrosion takes place later. Also there is an over damaging of serrations and wearing of the bottle finish, reducing the useful life of returnable bottles.

This utility model is intended to solve thereafter mentioned problems by its special and particular configuration: A curved portion between skirt's wall and crown top adapted to the same shape as the bottle finish mouth contour that, at the same time, allows a reduction of the original blanking diameter, producing more crowns per sheet.

SUMMARY OF INVENTION

This utility patent is basically referred to a cap generally known as "crown cork" used for sealing mainly glass bottles with carbonated (beer, soft drinks, etc) and non-carbonated beverages (juices, sauces, etc).

In this model, the curved portion between the crown skirt's wall and crown top is adapted exactly to the finish mouth contour of bottles, permitting a particular and novel configuration that avoids crown tilting, eliminates lacquer breakage of crowns and therefore internal corrosion, minimizes bottle finish damage during crowning and during opening of bottles, improves useful life of crowner's elements, and reduces blank diameter of crown shells, allowing more crowns to be produced per sheet.

BRIEF DESCRIPTION OF THE DRAWINGS

A full understanding of the invention can be gained from the following description of the preferred embodiments when read in conjunction with the accompanying drawings in which.

DESCRIPTION OF THE INVENTION

This utility patent is basically referred to a cap generally known as "crown cork" used for sealing mainly glass bottles with carbonated (beer, soft drinks, etc) and non-carbonated beverages (juices, sauces, etc).

Figure 2A:
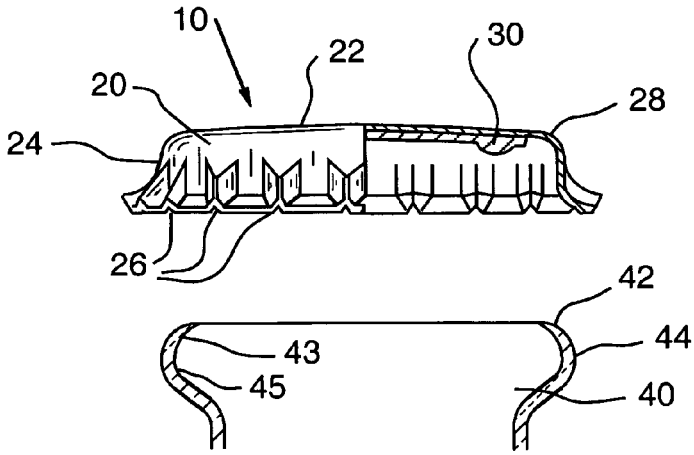
FIG. 2A partial cross-sectional elevation view of a crown closure according to the present invention.
Figure 2B:
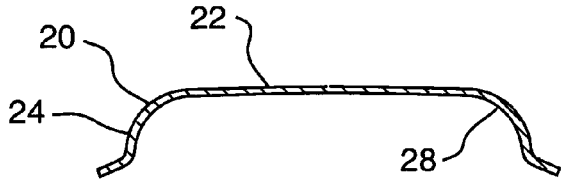
FIG. 2B is detail cross-sectional view of a crown closure according to the present invention.
Figure 2C:
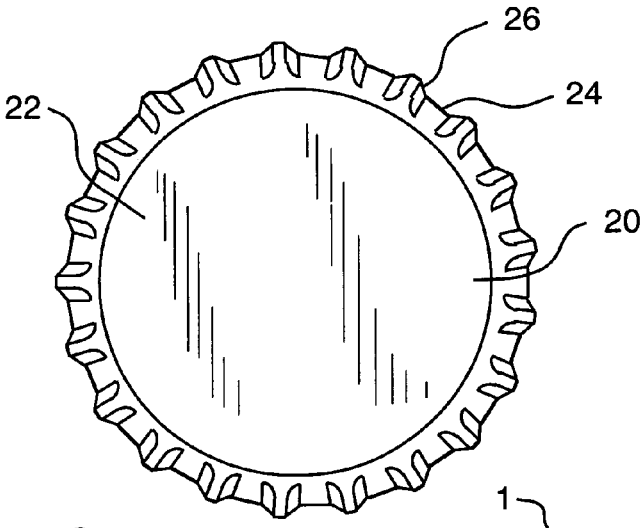
FIG. 2C is a top view of a crown closure according to the present invention.
Figure 3:
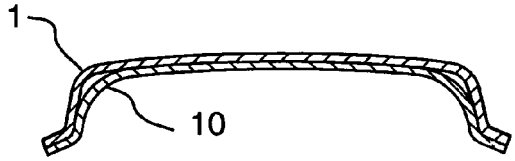
FIG. 3 is a cross-sectional view comparing the prior art to the present invention.
Figure 4:
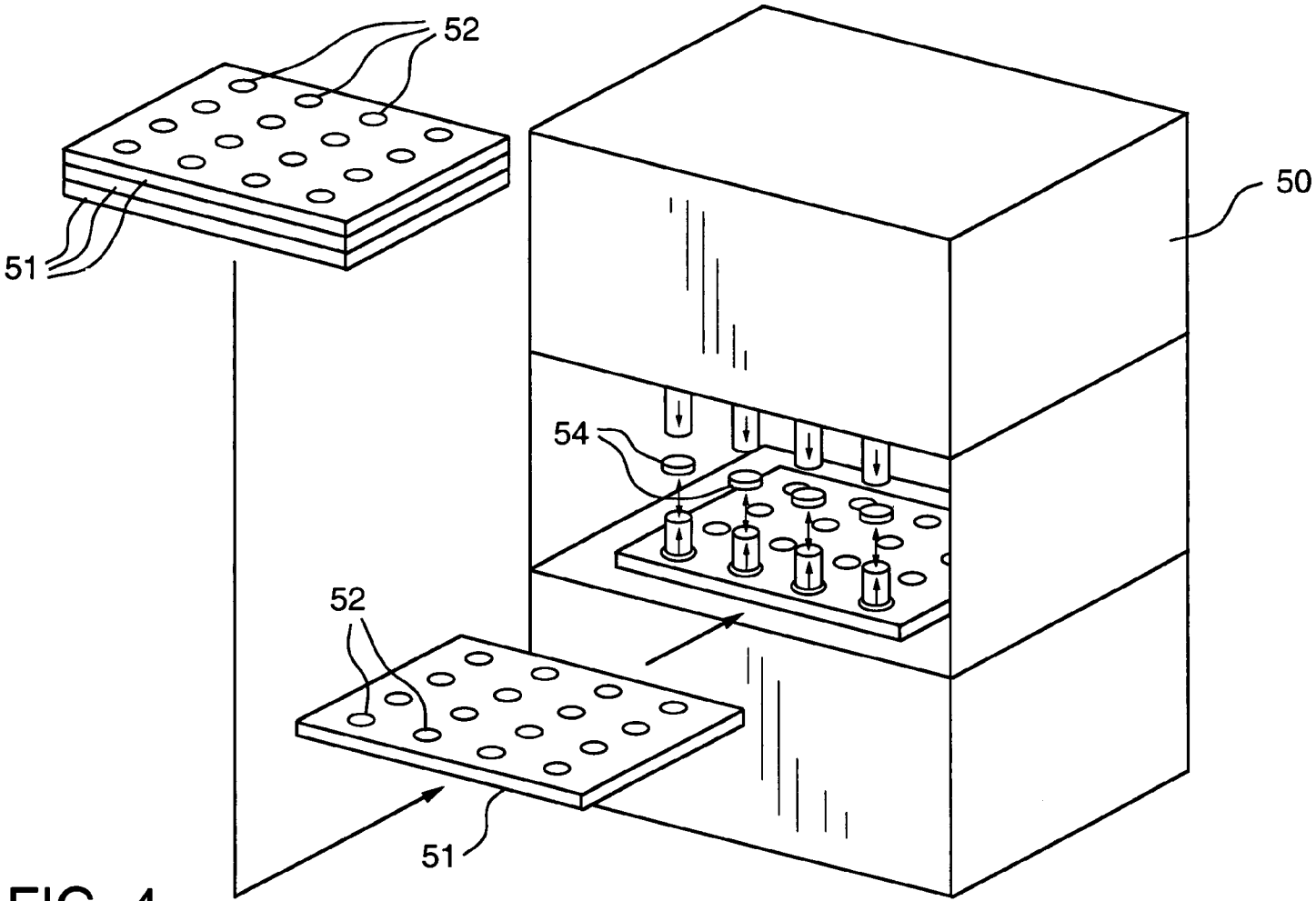
FIG. 4 is a schematic of the manufacturing equipment.

As shown in FIGS. 2A-2C, a crown cork 10, subject of this utility model, has two main parts: a crown shell 20 and a liner 30. This crown shell 20 includes a top 22, a skirt 24 and serrations 26.

The crown cork 10, see FIGS. 2A and 2B, has a special and particular internal curved portion 28 disposed between the top 22 and the skirt 24 which is adapted to be the same shape as the mouth contour 42 of a bottle 40. The bottle 40 has an upper end 41 having a mouth contour 42. The mouth contour has an upper portion 43 and a lower portion 45. Between the upper portion 43 and lower portion 45 is a fulcrum 44. The fulcrum 44 has a radius which is greater than any part of the upper portion 43 or the lower portion 45. Crowns for finish 26-600 by GPI are shown in the Figures.

Figure 1A:
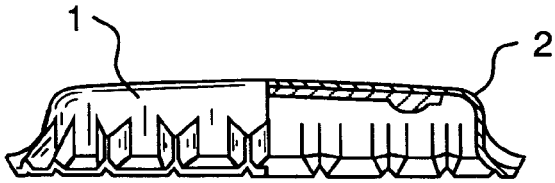
FIG. 1a Prior Art
FIG. 1A partial cross-sectional elevation view of a prior art crown closure.
Figure 1B:
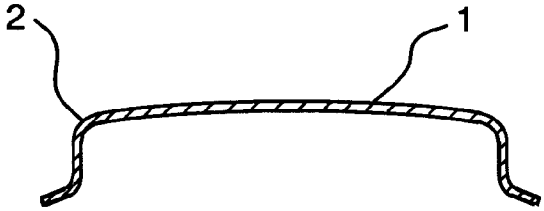
FIG. 1b Prior Art
FIG. 1B is detail cross-sectional view of a prior art crown closure.
Figure 1C:
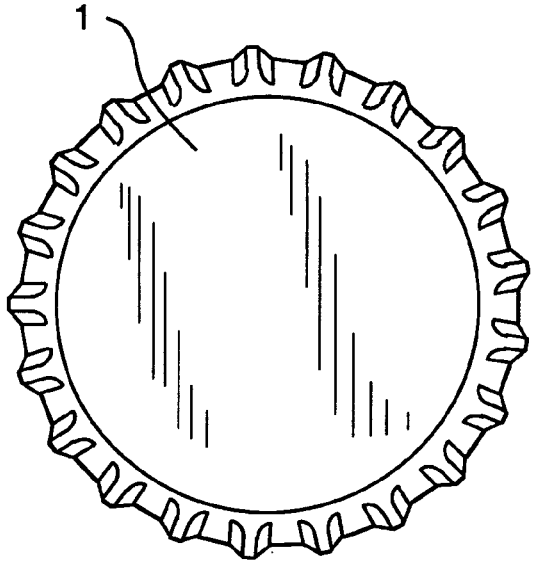
FIG. 1c Prior Art
FIG. 1C is a top view of a prior art crown closure.

This curved portion 28 has a radius which can vary slightly with tolerances and also the shape of the finish as stated by Glass Packaging Institute (GPI). For the series 26-600, 26-650 and related, this curved portion radius will be about 0.157 inch (4 mm) similar to finish mouth contour's radius until the fulcrum 44. Prior art crowns 1, as shown in FIGS. 1A-1C, have a curved portion 2 with a radius of 0.068-0.075 inch (1.7-1.9 mm).

For others finish models recommended by GPI, it will be apply the same idea: To have the internal curved portion with a radius equal to finish contour curvature radius.

Because of this new curved portion 28, it is necessary to make some modifications in manufacturing of the crown 10. For example, for finish 26-600 and related, the blank diameter of crown shells 20 must be reduced from 1.4446 inch (36.694 mm) to 1.3979 inch (35.506 mm).

Manufacture of crowns 10 is typically accomplished using a die press 50. A sheet of metal 51, typically tin or chromiumplated steel is lacquered on one side and varnished on the other side. A design, printing or both 52 may be lithographed onto the metal sheet 51 to indicate what product is in the bottle 40. The metal sheet 51 is inserted into a double action die press 50. This double action is obtained through a crank and cams which are so timed that on the down stroke of the press, the first action punches a plurality of crown blanks 54 from the metal sheet 51. As the main shaft keeps turning, the first action stops and the second action pushes the forming punches into the forming dies and form the crown blanks 54 into the proper shape. Crown shells 20 are then delivered to the compound applying or lining machines, were the liners 30 are applied. Because the curved portion 28 has a reduced radius, the diameter of the blank 54 may also be reduced. With this diameter reduction, in a typical sheet 51 used for making crowns 10, 8.42% more crowns 10 are obtained.

For the change from "Standard Crown" to "Short Skirt" it was stated that "the only difference between both is only in the height of the crown; all others dimensions remain the same." But really, between standard and short skirt crown, there is an important difference: the blank 54 diameter (parametrical cut) must be reduced in the latter. Prior art Short Skirt crowns 1 with the same die set pattern as used for standard crown, serrations obtained are really shorter with dissimilarity between them, affecting the crown's performance.

Further reduction, in order to change from short skirt crown 1 to the crown 10, makes it necessary to change the number of serrations 26, in order to maintain the original shape of the serration 26 of standard crown and a better crown performance. For example, as shown in FIG. 2C, a crown 10 with twenty serrations is shown, whereas In FIG. 1C, the short skirt crown 1 has twenty-one serrations.

It is necessary to mention here that the crown 10 diameter and height and the prior art crown 1 have the same dimensions and tolerances, in order to maintain the crowner's performance.

Crowns 10 with different number of serrations (and different shapes if necessary) could be designed, according to needs.

The particular shape of this crown 10 confers it particular characteristics, not shown by the prior art crown 1, as described as follows: eliminates crown tilting, harmful to a perfect seal, minimizes lacquer friction, avoiding lacquer's breakage because there is no stretching during crowning, due to the fact that the crown 10 has the same shape as the bottle 40 finish contour, avoiding also the internal post-corrosion, eliminates finish wearing or damage, due to the uneven stretching, during crowning and during the opening of bottles 40, easier opening of bottles 40 (uncrowning), reduces crowning forces around 30% in comparison with prior art crown, reducing also serrations abrasion and enlarging useful life of crowner elements, there are produced 8.42% more crowns per sheet 51 (crowns for finish 26-600 and related) in comparison with prior art crowns, because the proposed crown has a reduced blank 54 diameter, and increases productivity in areas as lithography, trimming and pressing. Reduces volume and weight in warehouse and increase of maximum capacity of shell production.

What is claimed is:

1. A crown closure comprising:

a shell having an inside, a top, a skirt, a curved portion and a plurality of serrations which do not project into said curved portion;

said curved portion disposed between said top and said skirt;

a liner secured to said inside; and wherein said curved portion is adapted to be the same shape as the mouth contour of a bottle.

2. The crown closure of claim 1 wherein said curved portion has a radius greater than about 1.7 mm.

3. The crown closure of claim 1 wherein said curved portion has a radius of about 0.157 inches (4 mm).

4. The crown closure of claim 1 wherein said shell is manufactured from a blank having a diameter of about 1.4 inches (35.5 mm).

5. The crown closure of claim 1 wherein said shell is formed from a blank having a diameter less than about 1.4446 inches.

6. The crown closure of claim 1 wherein said shell has twenty serrations.

7. A closed container comprising:

a bottle having a mouth;

a crown closure secured over said mouth;

said crown closure comprising:

a shell having an inside, a top, a skirt, a curved portion and a plurality of serrations which do not project into said curved portion;

said curved portion disposed between said top and said skirt;

a liner secured to said inside; and wherein said curved portion is adapted to be the same shape as the contour of said mouth.

8. The closed container of claim 7 wherein said curved portion has a radius greater than about 1.7 mm.

9. The closed container of claim 7 wherein said curved portion has a radius of about 0.157 inches (4 mm).

10. The closed container of claim 7 wherein said shell is manufactured from a blank, and said blank has a diameter of about 1.4 inches (35.5 mm).

11. The crown closure of claim 7 wherein said shell is formed from a blank having a diameter less than about 1.4446 inches.

12. The closed container of claim 7 wherein said shell has twenty serrations.

13. The closed container of claim 7 wherein:

said bottle mouth includes an upper portion and a lower portion with a fulcrum therebetween; and said curved portion has a radius that is similar to said upper portion.

* * * * *